United States Patent [19]

Foglesong et al.

[11] 4,303,375

[45] Dec. 1, 1981

[54] CLOSABLE VANE TURBINE VENTILATOR

[76] Inventors: Robert M. Foglesong, 3115 Del View, Del City, Okla. 73115; Terry D. Arden, 5009 Lunow, Oklahoma City, Okla. 73135

[21] Appl. No.: 145,931

[22] Filed: May 2, 1980

[51] Int. Cl.[3] ..... F01D 7/00

[52] U.S. Cl. ..... 416/167; 415/163; 98/72; 416/186 A

[58] Field of Search ..... 98/21, 34, 69, 72, 75; 415/163; 416/135 R, 167, 186 A

[56] References Cited

U.S. PATENT DOCUMENTS

| | | | |
|---|---|---|---|
| 1,341,045 | 5/1920 | Currey | 416/135 A |
| 2,253,406 | 8/1941 | Wagner | 416/186 A X |
| 2,383,004 | 8/1945 | Mader | 416/135 |
| 2,469,096 | 5/1949 | Wilson | 98/75 |
| 3,938,907 | 2/1976 | Magoveny et al. | 416/189 A X |
| 4,020,565 | 5/1977 | Steffen | 98/72 X |
| 4,123,001 | 10/1978 | Kolt | 98/72 X |

FOREIGN PATENT DOCUMENTS

| | | | |
|---|---|---|---|
| 1307113 | 9/1962 | France | 416/186 A |
| 624826 | 6/1949 | United Kingdom | 98/72 |
| 145688 | 4/1961 | U.S.S.R. | 416/186 A |

*Primary Examiner*—Everette A. Powell, Jr.
*Attorney, Agent, or Firm*—Robert K. Rhea

[57] ABSTRACT

In a rotary ventilator having a vertical shaft rotatably supporting a rain plate, a vertically movable ring, diametrically equal with the rain plate, surrounds the depending end portion of the shaft. A plurality of elongated vanes, vertically disposed in circumferentially spaced relation extend between the rain plate and movable ring and are supported for angular rotation about their vertical axes by the peripheral edge portion of the rain plate. The depending end portion of each vane is provided with a depending tab given a quarter twist about its vertical axis which projects through a cooperating slot formed in the peripheral edge portion of the movable ring. A lever, pivotally connected with the depending end portion of the shaft for vertical movement of its respective ends, lifts the movable ring toward the rain plate and imparts a partial angular rotation to the respective vanes, about their respective axis, from a normal open position to a ventilator closed overlapping position.

3 Claims, 6 Drawing Figures

CLOSABLE VANE TURBINE VENTILATOR

BACKGROUND OF THE INVENTION

1. Field of the Invention

The present invention relates to ventilators of the wind turbine type and more particularly to a ventilator having closable vanes.

Many residences are provided with attic ventilators, generally referred to as wind driven turbine type ventilators, which are mounted on the upper surface of a roof and communicates with the attic through an aperture therein for the purpose of dissipating moisture contained in the air within the attic and dissipating heat trapped in the attic during hot weather. However, many home owners desire to close the roof ventilating aperture during cold months of the year to prevent heat loss from the dwelling escaping through the ceiling thereof.

This invention provides a turbine ventilator having vanes moved to a ventilator closed position.

2. Description of the Prior Art

It is common practice to close building ventilators equipped with wind driven turbines by placing a plastic cover, or the like, over the entire ventilator during cold months of the year, however, this requires gaining access to the roof, such as by the use of ladders, or the like, and the roof pitch of some buildings is such this is not easily accomplished.

This invention overcomes the disadvantage or inconvenience of placing an exterior cover over the ventilator by constructing the ventilator so that the wind driven vanes thereof may be pivoted about a vertical axis of the respective vane from an open to a closed nondriving position by a control disposed remote from the ventilator.

Prior patents disclose a plurality of turbine or wind driven ventilators for ventilator or exhaust stacks in which the vanes of the respective turbine are rigidly connected to the other components forming the ventilator.

This invention is distinctive over such ventilators by forming the vanes of the ventilator in elongated panel form which are vertically disposed and rotatable about the vertical axis of each vane from an opened wind driving position to a closed ventilator position by vertical movement of a vane connected guide ring.

SUMMARY OF THE INVENTION

The turbine comprises a base formed by a tubular skirt coaxially surrounding and secured to the vertically disposed upper end portion of a ventilator or draw pipe. The skirt includes a spider portion which coaxially supports a vertical shaft having bearing means at its upper end rotatably supporting a horizontal rain plate. The peripheral edge portion of the rain plate supports the upper end of a plurality of circumferentially equally spaced panel-like vanes for angular rotation about their respective axes. A vertically movable horizontal ring, having a depending annular flange surrounding the upper end portion of the skirt, is rotatably connected with the shaft by a plurality of spokes. Each vane is provided with a depending tab partially twisted out of the plane of the respective vane in one direction with these tabs vertically slidably entering cooperating circumferentially spaced slots formed in the vertically movable ring adjacent its periphery and secured therein by fasteners. The vanes thus support the movable ring. The movable ring is lifted vertically relative to the vanes by a lever pivotally connected for vertical movement with the depending end portion of the shaft above the skirt which simultaneously rotates the vanes about their respective vertical axis, in one direction, to a closed position in which the respective vertical edges of adjacent vanes are disposed in overlapped closed position. Upon release of the lever, the movable ring is biased downwardly by a spring surrounding the shaft and gravity and partially rotates the respective vanes to opened wind engaging position.

The principal object of this invention is to provide a wind driven turbine having movable vanes disposed in a selected closed or open position.

DESCRIPTION OF THE PREFERRED EMBODIMENT

Figure 1:
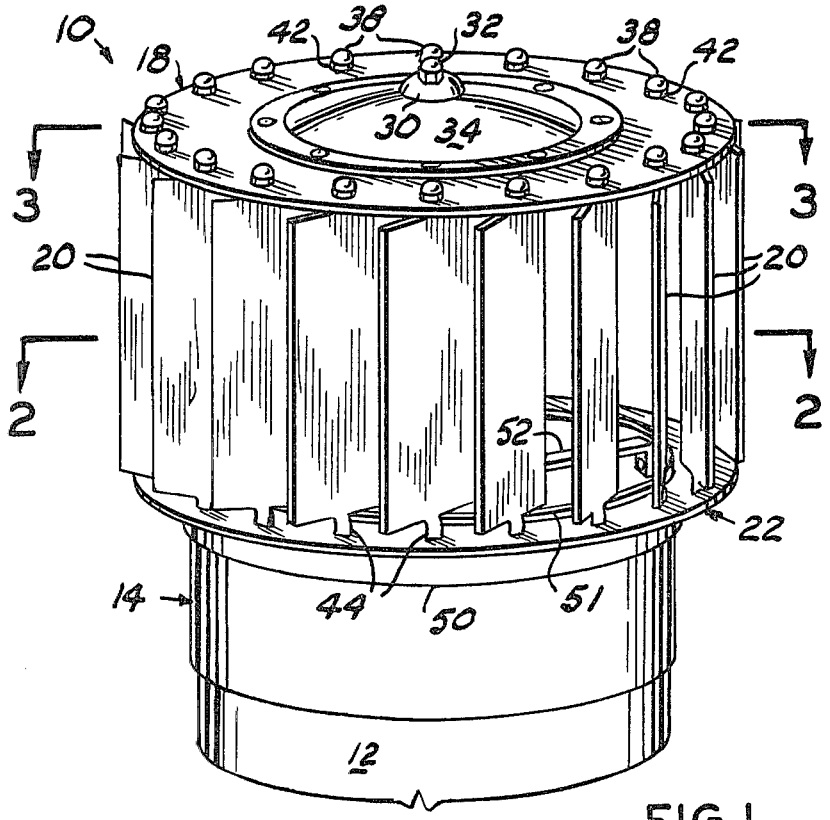
FIG. 1 is a perspective view of the turbine.

Like characters of reference designate like parts in those figures of the drawings in which they occur.

In the drawings:

The reference numeral 10 indicates a generally cylindrical turbine ventilator vertically supported by the vertically disposed upper end portion of a ventilator or draw pipe 12 projecting above the roof, or the like, not shown. The ventilator 10 includes a base skirt 14 centrally supporting a shaft means 16 in turn horizontally supporting at its upper end a turbine top or rain plate 18. A plurality of vanes 20 depend from the rain plate 18 and support a vertically movable vane actuator ring 22 for opening and closing the vanes, as hereinafter explained.

The base skirt 14 is diametrically smaller than the rain plate 18 and comprises a section of tubular material coaxially surrounding the upper end portion of the draw pipe 12 and having a spider 24 secured to its inner wall surface and surrounding the depending end portion of a bearing shaft 26 forming the core of the shaft means 16. A sleeve 28 surrounds the bearing shaft 26 and forms a bearing surface for the shaft 26 in combination with conventional bearing means, not shown, within the sleeve at the upper end portion of the shaft which includes a cap 30 and acorn nut 32 disposed above a dome plate 34 overlying the rain plate 18 for securing the rain plate to the shaft for angular rotation therearound.

The vanes 20 comprise elongated rectangular panel sections of thin sheet metal which are vertically disposed in circumferential equally spaced depending relation adjacent the peripheral edge of the rain plate 18. The vanes 20 each have a central integral upstanding tab 36 forming an upper set of vane connecting end portions which project upwardly through suitable apertures formed in the rain plate 18 adjacent its periphery and is secured by cap-like fasteners 38 engaging opposing slots 40 formed in the respective sides of the tab 36 with a friction reducing washer 42 interposed between the cap 38 and upper surface of the rain plate. When in opened position, as presently described, the vanes 20 are disposed substantially tangential to a cylindrical plane generated by the periphery of the skirt 14. Obviously, a short rod, or the like, not shown, may be secured to the upper end of each vane 20 in place of the tab 36, if desired. The length of the vanes 20 is determined by the desired height for the turbine 10 and the number of vanes employed is a matter of choice in accordance with the outside diameter of the rain plate 18. The spacing between the vanes being determined in accordance with their transverse width to achieve an overlapping configuration when closed, as presently explained.

Figure 6:
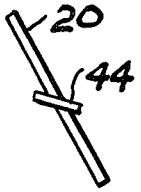

Each of the vanes 20 is similarly provided with a central depending integral tab 44 forming a lower set of vane connecting end portions of selected length with each tab 44 given a quarter twist about its longitudinal axis (FIG. 6) to form opposing cam surfaces. The depending end portion of each tab 44 projects downwardly through a cooperating tab cam surface engaging slot formed in the peripheral edge portion of the movable ring 22 and is secured therein by a clip fastener 46 engaging opposing slots 48 formed in the lower tab adjacent its depending end. The several vanes support the movable ring 22 in combination with a thrust bearing, as presently described.

The movable ring 22 is diametrically equal with the rain plate 18 and is further characterized, at its inner periphery, by a depending annular flange 50 coaxially surrounding the upper end portion of the skirt 14 and an upstanding annular rain flange 51 in the plane of the flange 50. The movable ring 22 is provided with a plurality of spokes 52 connected at their converging ends between a pair of hub forming clamp rings 54 and 56 vertically slidably surrounding the depending end portion of the sleeve 28. An upstanding stub sleeve 58 integral with the top clamp ring 54, coaxially surrounds the depending end portion of the sleeve 28. A helical spring 60 is interposed between the top clamp ring 54 and depending surface of the dome cap 34 around the sleeves 28 and 58 and normally biases the movable ring 22 downwardly.

One end portion of an elongated split clamp 62 surrounds and grips the depending end portion of the bearing shaft 26 above the spider 24 and below the sleeve 28. A nut 64, on the depending end of the bearing shaft 26, impinges the spider 24 against the split clamp 62. A ring-like pressure plate 66, surrounding the depending end portion of the sleeve 28, overlies the split clamp 62. A friction reducing thrust bearing 68, surrounding the depending end portion of the sleeve 28, is interposed between the pressure plate 66 and adjacent clamp ring 56. The purpose of the bearing 68 is for supporting the movable ring 22 in combination with the vanes 20 during angular rotation of the turbine.

Figure 2:
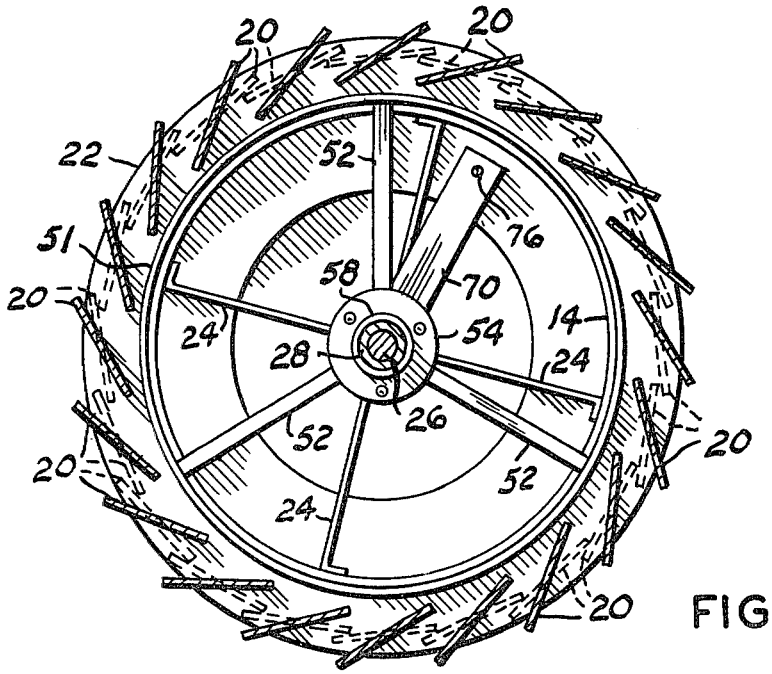
FIG. 2 is a horizontal sectional view taken substantially along the line 2—2 of FIG. 1 illustrating the vanes in closed position by dotted lines.
Figure 4:
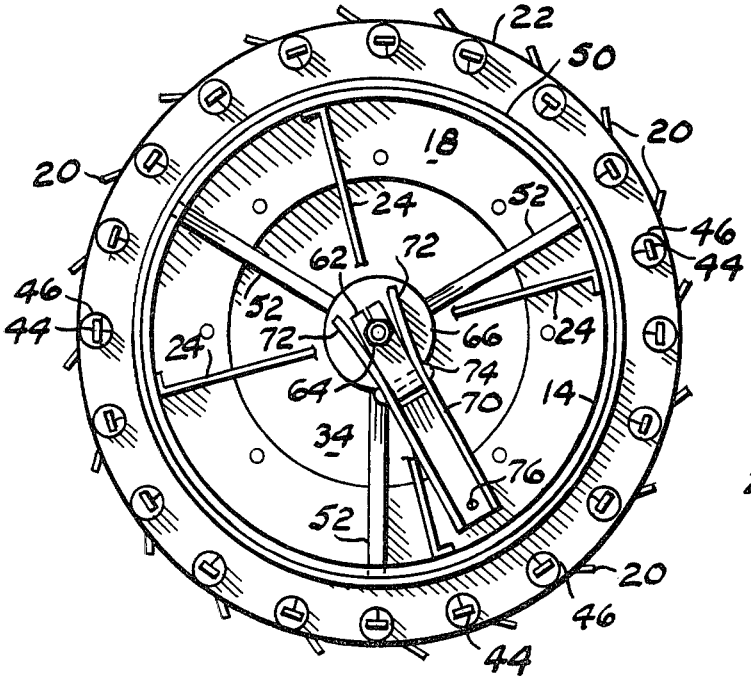
FIG. 4 is a bottom view.
Figure 5:
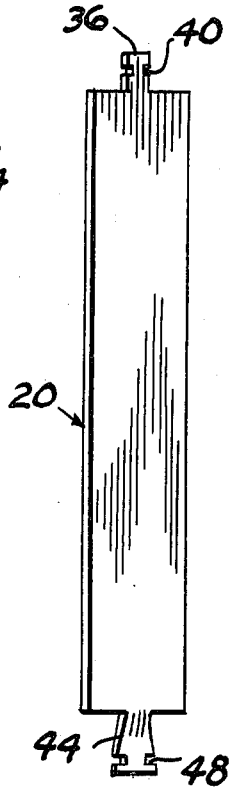
FIG. 5 is a perspective view, to a larger scale, of one of the vanes, per se; and, FIG. 6 is a bottom end view of FIG. 5.
Figure 3:
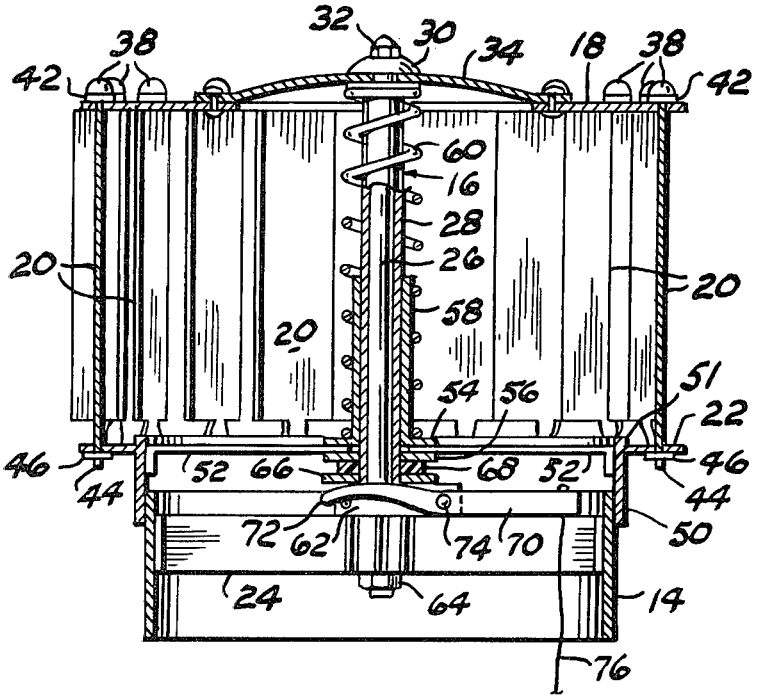
FIG. 3 is a vertical cross sectional view taken substantially along the line 3—3 of FIG. 1.

A lever 70 is bifurcated at one end portion to provide a pair of arms 72 which longitudinally straddle the split clamp 62 and are pivotally connected by a transverse pin 74 with the other end portion of the split clamp 62 for vertical pivoting movement of the respective ends of the lever about the axis of the pin 74. The arms 72 are arcuately bowed upwardly intermediate their ends for sliding contact with the bearing plate 66 in response to downward movement of the other end portion of the lever 70 accomplished by a flexible member 76 connected thereto. The purpose of the lever 70 is to lift the movable ring 22 relative to the vanes 20 which angularly rotates the respective vanes 20 about their vertical axes through an arc of predetermined magnitude from an open wind engaging position, shown by solid lines, to a closed position, illustrated by dotted lines (FIG. 2).

OPERATION

In operation, the turbine 10, mounted on the upper end portion of the draw pipe 12, is normally in the position illustrated by FIG. 1 wherein a breeze or wind engaging the open vanes 20 angularly rotates the turbine in a conventional manner. The spring 60 maintains the movable ring 22 disposed downwardly during normal operation of the turbine. When it is desired to close the vanes 20, the flexible element 76 is manually pulled downwardly pivoting the lever arms 72 against the pressure plate 66 which in turn, by the bearing 68 and clamp rings 54 and 56, lift the movable ring assembly 22 against the tension of the spring 60 thus imparting angular rotation of the respective vanes 20 to the closed position illustrated by dotted lines (FIG. 2). The flexible element 76 is secured to any suitable fastener for maintaining tension on the lever 70 during the closed vane position.

Upon release of the flexible element 76, the spring 60, assisted by gravitation attraction for the movable ring 22, biases the movable ring downwardly and pivots the respective vane to an opened wind engaging position.

Obviously the invention is susceptible to changes or alterations without defeating its practicability. Therefore, we do not wish to be confined to the preferred embodiment shown in the drawings and described herein.

We claim:

1. A turbine ventilator, comprising:

a tubular skirt adapted to be secured in upstanding relation to the upper end portion of a ventilator shaft, or the like;

a spider secured to the inner periphery of said skirt;

an upstanding shaft coaxially supported at its depending end portion by said spider;

a horizontally disposed disk-like rain plate coaxially journalled by the upper end portion of said shaft for angular rotation;

a moveable plate-like ring horizontally surrounding said shaft above said skirt for vertical movement toward and away from said rain plate, said moveable ring having a depending flange telescopically surrounding the outer periphery of the upper end portion of said skirt and having radial inwardly projecting spokes;

superposed clamp rings vertically slidably surrounding said shaft and impinging the inwardmost end portions of said spokes;

a plurality of panel-like vanes extending vertically in circumferentially spaced relation between corresponding peripheral edge portions of said rain plate and said moveable ring in a like plurality of respective planes normally substantially tangential to a cylindrical plane generated by the periphery of said skirt, each said vane having a longitudinally extending tab centrally formed on its respective end forming upper and lower sets of tabs, each tab of at least one set of tabs having a quarter twist about its longitudinal axis to form opposing cam surfaces, said rain plate and said moveable ring each having a row of circumferentially spaced-apart apertures disposed in cooperative relation for receiving the respective upper and lower sets of tabs, at least one row of said rows of apertures comprising vertical slots for receiving said set of quarter twisted tabs and slidably engaging said tab cam surfaces;

a plurality of fasteners connected with the end of each tab of said sets of tabs projecting through said rain plate and said moveable ring, respectively; and, lever means interposed between said moveable ring and said skirt and secured to said shaft for lifting said moveable ring toward said rain plate, at least one set of said sets of tabs angularly rotating said plurality of vanes in unison through an arc of predetermined magnitude in response to movement of said moveable ring toward said rain plate.

2. The ventilator according to claim 1 and further including:

a stub sleeve surrounding the depending end portion of said shaft means and secured to the uppermost said clamp ring for maintaining said moveable ring means horizontal during its vertical movement; and, a spring interposed between said rain plate and the uppermost said clamp ring for normally biasing said moveable ring means downwardly.

3. The ventilator according to claim 1 or 2 in which said lever means includes:

a split clamp surrounding the depending end portion of said lever means above said spider;

a pressure plate surrounding said shaft above said split clamp;

bearing means interposed between said pressure plate and the lowermost said clamp ring;

a lever pivotally connected horizontally intermediate its ends with said split clamp for vertical movement of its respective end portions about a horizontal axis, one end portion of said lever being bifurcated and straddling said shaft below said pressure plate; and, a flexible element connected with the other end portion of said lever for biasing said lever other end portion downwardly.

* * * * *